United States Patent [19]

Blankenship

[11] Patent Number: 4,464,790

[45] Date of Patent: Aug. 7, 1984

[54] BAG WITH CLOSED VALVE

[75] Inventor: Bernard F. Blankenship, Bay Village, Ohio

[73] Assignee: Basic Packaging Systems, Inc., Avon Lake, Ohio

[21] Appl. No.: 388,467

[22] Filed: Jun. 14, 1982

[51] Int. Cl.[3] ..... B65D 30/24

[52] U.S. Cl. ..... 383/37; 383/44

[58] Field of Search ..... 229/62.5, 53, 69; 150/9; 53/450, 455; 383/37, 44, 57

[56] References Cited

U.S. PATENT DOCUMENTS

| | | | |
|---|---|---|---|
| 3,559,874 | 2/1971 | Titchenal | 229/69 |
| 3,746,246 | 7/1973 | Murray | 229/62.5 |
| 3,779,449 | 12/1973 | Membrino | 229/69 |
| 3,791,573 | 2/1974 | Titchenal et al. | 229/69 |
| 4,073,429 | 2/1978 | Lawes | 229/62.5 |

FOREIGN PATENT DOCUMENTS

| | | | |
|---|---|---|---|
| 709244 | 5/1965 | Canada | 229/62.5 |
| 2752489 | 5/1979 | Fed. Rep. of Germany | 229/53 |

*Primary Examiner*—Stephen P. Garbe

*Attorney, Agent, or Firm*—Pearne, Gordon, Sessions, McCoy, Granger & Tilberry

[57] ABSTRACT

A valve bag and a series of interconnected valve bags is disclosed wherein the bag is constructed from first and second walls, with one wall having first and second overlapping panels. The valve is formed between unsealed portions of the overlapping panels, and other areas of the overlapping portions are sealed together. A tunnel is provided along a first edge of the series of bags so that the series may be guided into a bag filling machine. This tunnel is to be threaded by a mandrel to align the series of bags in the bag filling machine. As constructed, the valves in the bags are sealed closed, and only at the filling machine is the tunnel slit open by a cutter to expose the exterior opening of the valve so that the bag may be filled through this valve.

20 Claims, 12 Drawing Figures

BAG WITH CLOSED VALVE

BACKGROUND OF THE INVENTION

Valve bags have been used for many years for packaging a wide variety of materials including cement and fertilizer. Valve bags are those having a small opening, smaller than the entire top of the bag, which type is generally referred to as "open top bags." Valve bags have an important advantage of easy filling through a valve structure, yet the valve may be self-closing after filling, due to the weight and volume of the filled contents. Also, valve bags are often used where the contents of the bag may be dusty and may prevent satisfactory and positive sealing of the bag. A number of prior designs for valve bags have been ones wherein the valve was a separate structure, often of a thin material, in order to provide the necessary antisift qualities to the valve after filling the bag. This separate valve structure was shown in U.S. Pat. Nos. 2,895,387; 3,394,871; and 3,221,789, and it necessitated considerable cost and complexity in the manufacture of the bags in order to insert this separate valve sleeve, position it properly, and fix it in position.

Practically all valve bags were produced as individual bags and the valve manually inserted onto a filling spout, the bag filled with the desired contents, and then removed from the spout. Often the valve was tucked inside the bag by the operator so that the valve would be closed by the weight and bulk of the contents when the bag was laid flat. These individual bags required considerable labor cost in the filling of the bags because such manual handling for filling was slow, tedious, and often dangerous if the bags were being filled with toxic or hazardous material.

U.S. Pat. No. 3,746,246 showed a valve bag not requiring any separate supplemental valve sleeve to be inserted during its manufacture, the valve being constructed from the overlapping material of the bag itself. However, the bags still were separate, individual bags which required the manual operator to deftly manipulate the valve of the bag onto the filling spout during the filling operation and manually remove the bag from the spout upon completion of the filling, and hence this was also a slow filling operation, with considerable labor expense. A similar construction was found in U.S. Pat. No. 3,833,166.

U.S. Pat. Nos. 3,559,874; 3,583,127; 3,699,746; 3,791,573; and 3,817,017 disclosed an interconnected chain of bags with a tunnel at the top edge for guidance of this chain of bags onto a mandrel of a bag-filling machine, with the bags being open-top bags for filling. In cases of powder being shipped in bags, often the bags need to be sterile so that the powder, e.g. foodstuffs, is not contaminated. If valve bags are utilized, which are often used with powdery contents, it is difficult to maintain the sterility of the interior of the bag during shipment and storage before use at a bag filling machine. This is due to the fact the valve in the bag permits a passage of air into and out of the bag, especially with changes in atmospheric pressure. Where the bag is being shipped or stored in non-sterile conditions, which is the usual case, this can seriously affect the sterile condition of such bags.

Accordingly, the problem to be solved is how to provide a bag in a series of interconnected bags so that the bags are provided with valves, so that they may be filled on an automatic bag filling machine rather than by manual filling, and so that the bag valve is closed during shipment and storage in order to minimize contamination inside the bags, or even to maintain sterility inside the bags.

SUMMARY OF THE INVENTION

This problem is solved by an interconnected series of valve bags comprising, in combination, a first wall and a second wall connected together near all edges to form a substantially closed bag, said first wall being formed from first and second panels partially overlapping each other, at least one panel seal sealing between said first and second panels at the overlapping areas thereof with said panel seal terminating near a first valve side line transverse to a first edge of said bag, a second valve side line spaced from said first line and transverse to said first edge of a seal between said first and second panels at the overlapping areas thereof, a valve being defined between said two valve side lines and the unsealed portions therebetween of said overlapping first and second panels, the interior end of said valve being defined by a portion of said first panel and having a closed yet openable exterior end defined by a portion of said second panel, the overlapping of said first and second panels defining a self-closing valve after opening thereof and filling the bag with the desired contents, alignment means on said bag adjacent said first edge and substantially continuous across said bag, and interconnecting means at least near said alignment means connecting each bag to an adjacent bag to form an interconnected series of bags with a substantially continuous alignment means along said series of bags for guidance of the series of bags along a reference line of a bag filling machine for sequential filling of the bag.

This problem is further solved by a valve bag comprising, in combination, a first wall and a second wall connected together near all edges to form a substantially closed bag, said first wall being formed from first and second panels partially overlapping each other, a tunnel formed adjacent a first edge of the bag by portions of at least one of said walls, said tunnel being defined between said first edge and a tunnel seal spaced from said first edge with the tunnel seal being between said first and second panels, a plurality of panel seals spaced from said first edge and sealing between said first and second panels at the overlapping areas of said panels with said plurality of seals terminating along a first valve side line perpendicular to said first edge, a second valve side line of a seal perpendicular to said first edge and sealing between said first and second panels at the overlapping areas of said panels, a valve being defined between said two valve side lines and between unsealed overlapping portions of said first and second panels, the interior end of said valve being defined by an end of said first panel and the exterior opening of said valve being temporarily closed by the slittable first edge of the bag at said tunnel, the overlapping of said first and second panels defining a self-closing valve after filling the bag with the desired contents, the portions of said walls defining said tunnel being connected to adjacent bags in an interconnected series of bags to guide, orient, and align the bags movable serially onto a mandrel in a bag filling machine to have the tunnel slit near the first edge thereof for release from the mandrel either before or after filling the same with the desired contents.

Accordingly, an object of the invention is to provide a valve bag with a closed exterior opening.

Another object of the invention is to provide a valve bag wherein the valve is sealed closed and must be slit open before filling the bag.

A further object of the invention is to provide a series of interconnected valve bags so that the series may readily be supplied to an automatic bag filling machine.

A still further object of the invention is to provide a series of interconnected valve bags each having alignment means for guidance thereat into a bag filling machine, the bags being filled through a valve at the alignment means.

Another object of the invention is to provide a series of interconnected valve bags with an alignment tunnel for guidance onto a mandrel of a bag filling machine, and with the tunnel being slit open and the bag being filled through the opened tunnel and through the valve into the bag.

Other objects and a fuller understanding of the invention may be had by referring to the following description and claims, taken in conjunction with the accompanying drawing.

DESCRIPTION OF THE PREFERRED EMBODIMENTS

Figure 1:
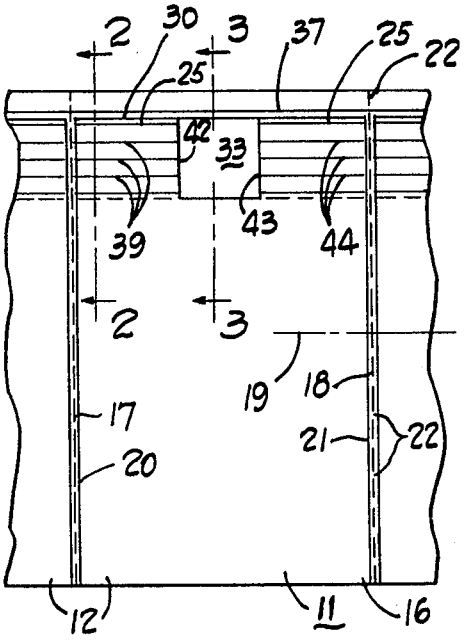
FIG. 1 is a plan view of a series of interconnected valve bags made according to the invention.

FIGS. 1–4 illustrate a valve bag 11 in a series 12 of such bags 11. Each bag is formed from first and second walls 13 and 14, respectively, and these bags are generally rectangular, with the walls connected together near all four edges to form a substantially closed bag. The bag 11 has a first or top edge 15 and a second or bottom edge 16, each of which is closed. The bag 11 also has third and fourth side edges 17 and 18. The walls are interconnected at or near these four edges and in the present case the bags 11 are formed from a continuous tube of a plastic film, such as a heat-sealable plastic film. This may be polyethylene as one example. The tube film has a longitudinal axis 19 and is flattened to form the first and second edges 15 and 16 of each bag. Accordingly, the connection between the first and second walls at these edges 15 and 16 is a unitary connection of the film material itself.

The bag side edges 17 and 18 are formed by interrupted perforations, which preferably are cold perforations rather than hot, so that the two films are not sealed together by the hot perforating knife. The perforations are interrupted by lands 22 which form the interconnections between bags 11 to form the series or chain of bags 12. The first and second walls 13 and 14 are interconnected near the side edges 17 and 18 in order to form the substantially closed bag, and in this preferred embodiment they are interconnected by seal lines 20 and 21 adjacent the third and fourth side edges 17 and 18, respectively. These seal lines may be formed by an adhesive between the walls 13 and 14; however, where the bag material is made from a heat-sealable film, heater bars may be used to supply heat and pressure to seal together these walls along the seal lines 20 and 21.

The seal lines 20 and 21 extend completely from the bottom edge 16 of the bag up to a tunnel seal 25, but not across such tunnel seal, in order to form a continuous tunnel 26 along the series 12 of bags. The lands 22 are also at the interconnection means between bags, at least at this tunnel 26, so that the tunnel will form an alignment means to align the bags for orientation and guidance along a reference line into an automatic bag filling machine. In each bag, the tunnel 26 is formed by tunnel portions 27 and 28 of the bag walls. Further, this tunnel is formed by the first edge 15 and it is bounded for much of its length by the tunnel seal 25.

Each valve bag 11 includes a valve 33 which may be used for filling the bag 11. In this preferred embodiment, the valve 33 is formed in the first wall 13. The first wall 13 is formed from a first and second panel 34 and 35, with the second panel overlapping the first panel. The first panel 34 has a bottom edge 36 and the second panel has a top edge 37. More specifically, there is an overlapping portion 41 of the second panel 35 which overlaps a portion 40 of the first panel 34.

In the manufacture of the series 12 of bags 11, the continuous tube of plastic film is slit open longitudinally, parallel to axis 19, and overlapped slightly, so that the second wall 14 overlaps the panel portion 40. Then an edge seal 30 is formed, e.g., by heat and pressure, to secure the second wall 14 to the overlapping panel portion 40. This forms the substantially closed bag.

The valve 33 is disposed between first and second valve side lines 42 and 43, respectively, and the first valve side line 42 is a line of discontinuous or preferably a continuous seal between the overlapping panel portions 40 and 41. These overlapping portions 40 and 41 are interconnected by one or more panel seals 39. A plurality of such panel seals are shown with at least one closely adjacent the top edge 37 of the first wall 14, which is also closely adjacent the tunnel seal 25. Another panel seal 39 is closely adjacent the bottom edge 36 of the first panel 34. To prevent the contents 46 of the bag from getting between the overlapping portions 40 and 41, especially if the valve side line is not continuous, the preferred embodiment shows a plurality of such panel seals 39 all generally parallel to the first edge 15.

The second valve side line 43 may be at the seal line 21 or, as shown in FIG. 1, may be spaced therefrom. This second valve side line 43 is also between the overlapping portions 40 and 41 of the panels 34 and 35, respectively. Again, there are preferably a panel seal 44 near the tunnel seal 25 and another panel seal 44 near the bottom edge 36 of the first panel 34. These panel seals 39 and 44 adhere together a majority of the overlapping portions 40 and 41 of the first and second panels, and the unsealed area between the overlapping portions 40 and 41 forms the valve 33.

Figure 2:
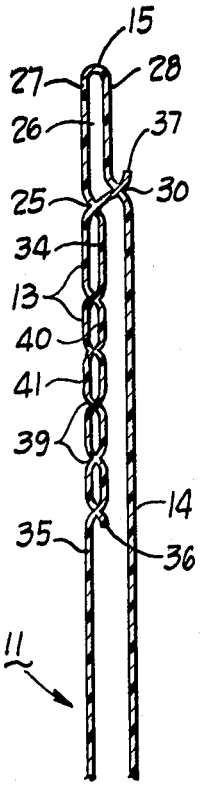
FIG. 2 is an enlarged, sectional view on the line 2—2 of FIG. 1.
Figure 3:
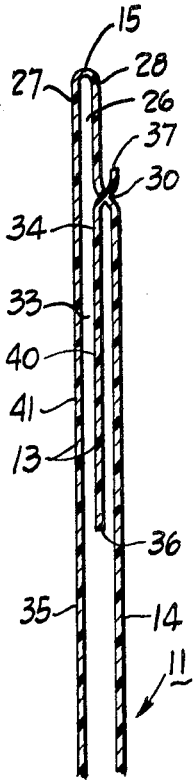
FIG. 3 is an enlarged, sectional view on the line 3—3 of FIG. 1.
Figure 4:
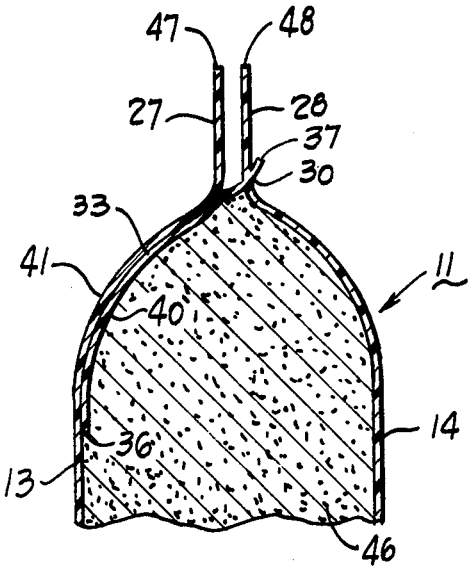
FIG. 4 is a view similar to FIG. 3, but with the bag filled.

The tunnel seal 25 is discontinuous across the width of the bag 11, and specifically is discontinuous at the valve 33. This has been described as a valve; however, this valve is sealed closed as the bag is manufactured. It is necessary to cut into the bag to slit it open so that the exterior opening to the valve is provided. In the preferred embodiment, the continuous tunnel 26 is utilized as an alignment means to align, orient, and guide the series of interconnected bags onto some guide means, e.g., a guide mandrel in an automatic bag filling machine. With the mandrel threading through the continuous tunnel 26, and with the mandrel having a cantilever support, one way to remove the bags from the mandrel, before or after filling the bags, is to slit open the bags along the edge 15. This will form two cut edges 47 and 48 of the tunnel 26, which will also provide an exterior opening to the valve 33. FIG. 4 illustrates this valve in the cut-open position, but FIGS. 1, 2, and 3 illustrate the tunnel as closed prior to slitting. The closed condition of the valve as manufactured, shipped, and stored helps to preserve the sterility of the bag where it is made under sterile conditions. Also, under less than sterile conditions, the contamination of the interior of the bag is prevented by the sealed-closed condition of the bag. It is only when the bag is about to be filled that the tunnel is slit open so that there is an exterior opening to the valve 33.

It will be noted that the bag during construction has the second wall 14 partially overlapping the first panel portion 40, and the first panel portion 40 is a unitary part of the second panel 35 because of the unitary connection at the first edge 15. It is because of the panel seals 39 and 44, which secure a majority of the overlapping portion 40 against that same piece of film, namely, the second panel portion 41, that the valve 33 is formed adjacent the first wall 13 rather than adjacent the second wall 14.

FIGS. 5–8 illustrate a further embodiment of the invention, showing a valve bag 51 in a series 52 of interconnected valve bags 51. The bags 51 are quite similar to the bags 11, and where the parts thereof are the same, the same reference numerals have been utilized. A difference between the bags 11 and 51 is that bag 11 is a pillow-style bag, with each of the four edges directly connecting together the first and second walls 13 and 14. In the bag 51 of FIGS. 5–8, a gusseted bag is shown, with end gussets, namely a top gusset 53 near the first edge 15 and a bottom gusset 54 near the bottom edge 16. The side seals 20 and 21 remain a direct connection between the first and second walls 13 and 14.

Figure 5:
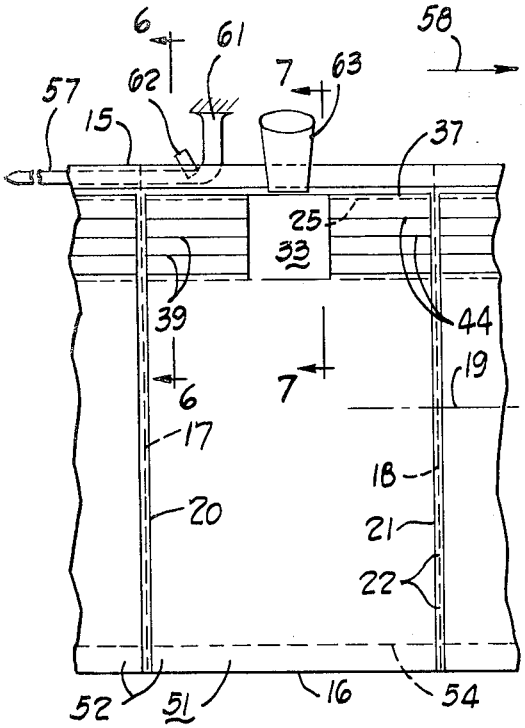
FIG. 5 is a plan view of a modified form of bag.
Figure 6:
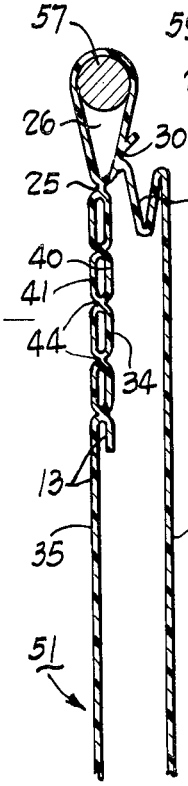
FIG. 6 is an enlarged, sectional view on the line 6—6 of FIG. 5.
Figure 7:
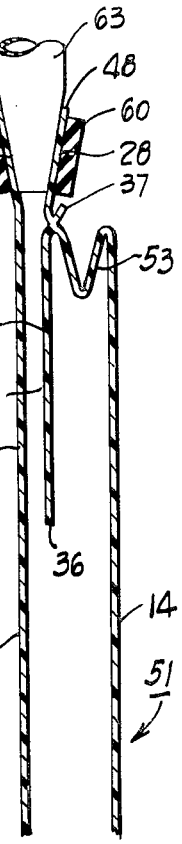
FIG. 7 is an enlarged, sectional view on the line 7—7 of FIG. 5.
Figure 8:
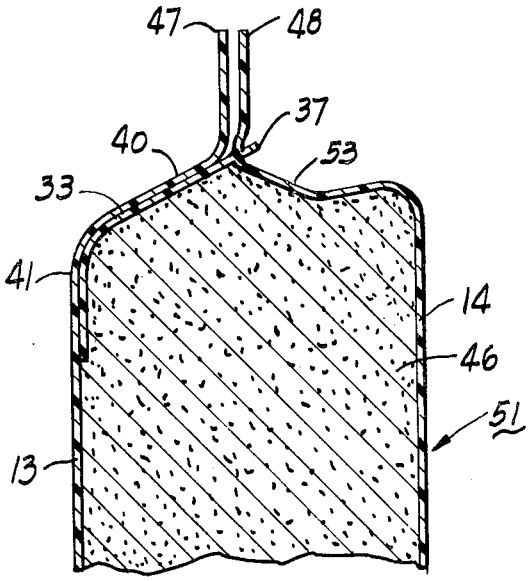
FIG. 8 is a view similar to FIG. 7, but showing the bag in a filled condition.

FIGS. 5, 6, and 7 have been changed from the counterpart FIGS. 1, 2, and 3 of the valve bag 11 in order to illustrate one possible way of utilizing the series 52, or the series 12, of bags in a bag filling machine. Such bag filling machine may utilize a guide mandrel 57 which threads through the continuous tunnel 26. The bags may move to the right along this mandrel, as shown by the arrow 58, and this movement may be effected by top edge belts 59 and 60 frictionally engaging the top edges or tunnel portions 27 and 28 of the bags, as diagrammatically illustrated in FIGS. 5 and 7. The forward end of the mandrel 57 would be in the left of FIG. 5, and the mandrel would have a cantilever support at 61 to some fixed part of the automatic bag filling machine. A cutter 62 mounted fixed relative to the mandrel 57 may be utilized to slit the edge 15 of the bag to form the two cut edges 47 and 48. The bags 51 may be successively indexed to a filling station whereat a filling spout 63 is located. This spout may move up and down, although this may often be unnecessary where the tunnel portions 27 and 28 spread to move around the filling spout 63. With the valve 33 of the bag 51 stopped at the filling spout 63, the contents from some hopper (not shown) may be used to supply the contents 46 of the bag through the spout 63 and the valve 33 into the interior of the bag 51. Upon further indexing movement, to have the next bag in line, the filled bag may be moved, e.g., by an optional bottom conveyor belt, to a position where it will break loose at the bag edge 17, due to the perforations thereat. This will break the lands 22, permitting the filled bag 22 to be removed from the series of bags. The bag may be laid flat on either the first or second wall 13 or 14, and if FIG. 8 is rotated 90 degrees, this will illustrate the filled bag. The valve 33 may be either at the top or the bottom of the bag, but in either case the weight and bulk of the filled contents will result in the valve 33 acting as a self-closing valve so that the contents 46 will not sift out of the valve 33.

FIGS. 9–12 illustrate a further embodiment of the invention of a valve bag 71 in a series 72 of such valve bags 71. These bags 71 are similar in shape to the bags 11 and 51 of FIGS. 1 and 5, respectively, yet they are formed from a tubular film which has a longitudinal axis 73. Such tube is flattened to form the bag and the bag has first and second edges 75 and 76, respectively. Third and fourth edges 77 and 78, respectively, are provided transverse to the longitudinal axis 73. These edges 77 and 78 are established by lines of cold perforations which are interrupted by lands 22 in order to form the interconnected series of bags. Seal lines 79 and 80 are provided adjacent the third and fourth edges 77 and 78, respectively, in order to directly seal together the first and second walls 81 and 82, respectively, which form the valve bag 71. Gussets 83 and 84 are provided adjacent the first and second edges 75 and 76, respectively, to interconnect the first and second walls 81 and 82. The side gussets 83 and 84 provided a gusseted bag, somewhat similar to the gusseted bag of FIGS. 5–8, except that the gussets are along the side rather than along the ends. Again, the perforations which form the edges 77 and 78 are preferably made with a cold knife so that the edges are not sealed together, especially at the portions of the bag which form a tunnel 86. Again, this is a continuous tunnel and it is bounded by tunnel portions 87 and 88 of the bag walls and partly by a tunnel seal 85, which is generally continuous parallel to and slightly spaced from the first edge 75, but is discontinuous at a valve 93. Again, the valve is formed between a first and a second valve side line 91 and 92, respectively. The first valve side line 91 again may be a continuous or discontinuous seal between overlapping portions 94 and 95 of first and second panels 96 and 97, respectively, which form the first wall 81. The first valve side line 91 marks a reference line which is the termination of panel seals 98 sealing between the overlapping portions 94 and 95. The second valve side line 92 may be spaced from the seal line 79 but, as shown, is contiguous therewith. If spaced therefrom, there would be additional panel seals between the overlapping portions 94 and 95. Again, the valve 93 is provided between unsealed areas of the overlapping portions 94 and 95. The tunnel seal 85 is discontinuous at this valve 93, but the first edge 75 is a unitary closed edge to seal closed the exterior opening of the valve 93. This is as the bag and series of bags are manufactured.

Figure 9:
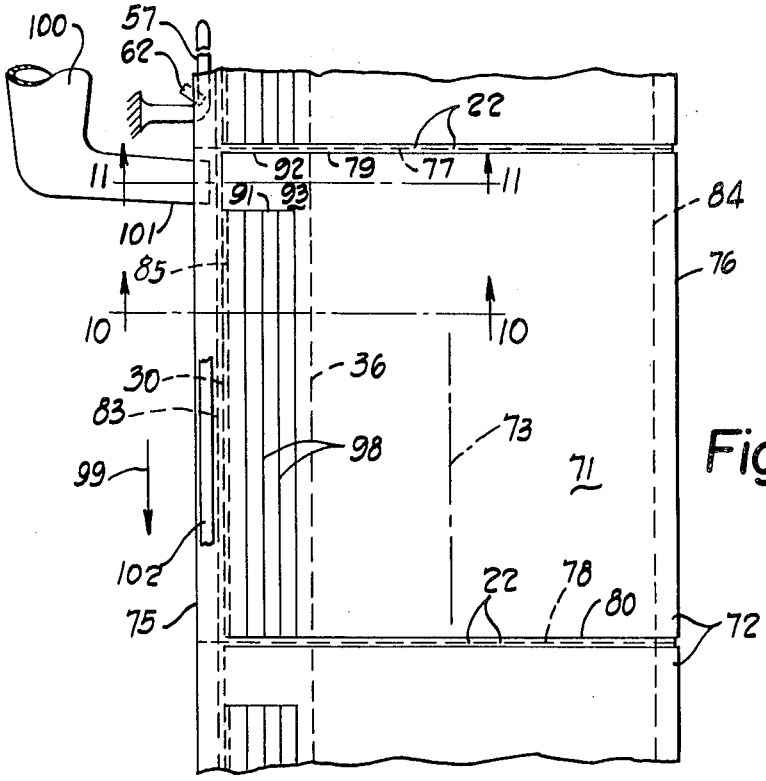
FIG. 9 is a plan view of a further modification of the invention.
Figure 10:
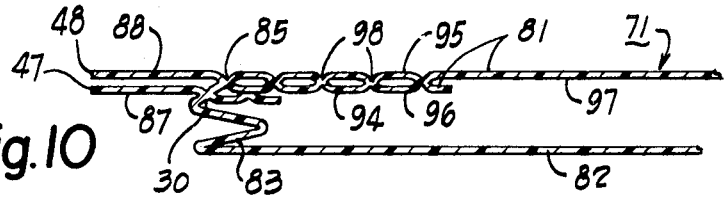
FIG. 10 is an enlarged, sectional view on the line 10—10 of FIG. 9.
Figure 11:
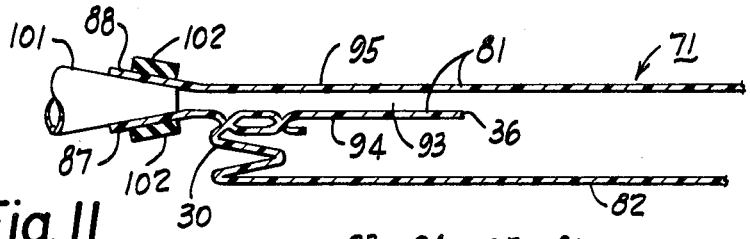
FIG. 11 is an enlarged, sectional view on the line 11—11 of FIG. 9.
Figure 12:
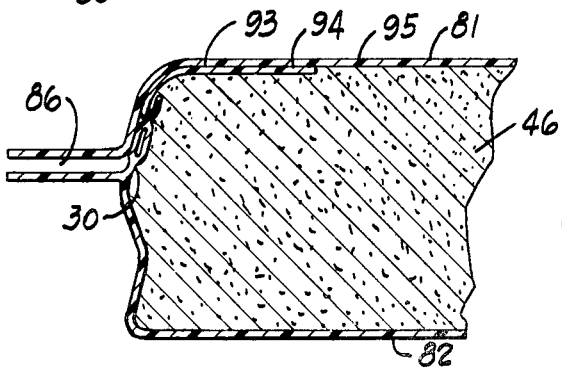
FIG. 12 is a sectional view similar to FIG. 11, but with the bag filled.

FIG. 9 illustrates how the series of bags may be supplied to a bag filling machine. The first edge 79 may be supplied to the bag filling machine in a horizontal position, as shown in FIG. 5; however, FIG. 9 illustrates an alternative arrangement, with the first edge 75 disposed vertically. The series of bags may move downwardly, as illustrated by the arrow 99. The mandrel 57 and cutter 62 are again used, this time with the front end of the mandrel 57 disposed upwardly. A filling spout 100 may have a right angle bend so that the discharge end 101 thereof may be positioned between the tunnel portions 87 and 88. Again, the series of bags may be moved so that the mandrel 57 threads the tunnel 86 and this movement may be provided by belts such as belt 102, which frictionally engage opposite sides of the tunnel portions 87 and 88. FIGS. 10–12 show the bags after the tunnel 86 has been slit by the cutter 62 to form the cut edges 47 and 48. After the bag is filled through the filling spout, the weight thereof preferably causes the lands 22 to rupture, so that the filled bag is removed from the series of bags. It may then be laid on its side, either the first wall 81 or second wall 82, and will then appear generally as shown in FIG. 12. The bulk and weight of the contents 46 will push closed the valve 93 so that the contents 46 will be retained inside the bag 71.

It will be noted in all three bags 11, 51, and 71 that the interior end of the valve is defined by a portion of the first panel, namely, the end 36 of the first panel 34 in FIGS. 1 to 8 and panel 96 in FIGS. 9–12. Also, it will be noted in all of the various embodiments that the exterior end of the valve is sealed closed as the bag is manufactured. It is sealed closed by the first edge 15 or 75, with the closed end being the unitary edge of the bag joining the first and second walls. This sealed-closed valve maintains cleanliness and prevents contamination of the interior of the valve and also, under sterile conditions, will maintain the sterile conditions within the bag. If necessary for complete sterility, the perforations across the tunnels at the edges of the bags may be eliminated and the ends of the tunnel for an entire series of bags sealed closed at the time of manufacture, remaining closed during shipment and storage of the series of bags. Such bags may readily be folded into a package in a zig-zag pattern, or may be rolled onto a drum, in either case providing easy removal for use in an automatic bag filling machine.

The tunnel 26 or 86 provides very convenient alignment means on each bag, the alignment means being adjacent and parallel to the first edge 15 or 75. Such alignment means is substantially continuous so that the guide mandrel may thread through such tunnel as the bags are fed to the bag filling machine. The interconnecting means between each bag is provided at least near each tunnel on each bag to form the interconnected series of bags so that the mandrel will, without fail, thread through such continuous tunnel. The alignment means is a physical alignment surface for contact with the bag filling machine, namely, the mandrel 57 in such machine. Further, it will be noted that the alignment means is a portion of the walls substantially parallel to the first edge 15 or 75, and in fact is the surface of the tunnel immediately opposite the first edge 15 or 75, through the thickness of the film forming the walls of the bag.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. An interconnected series of valve bags comprising, in combination, a first wall and a second wall connected together near all edges to form a substantially closed bag;

said first wall being formed from first and second panels partially overlapping each other;

at least one panel seal sealing between said first and second panels at the overlapping areas thereof with said panel seal terminating near a first valve side line transverse to a first edge of said bag;

a second valve side line spaced from said first line and transverse to said first edge and including a seal between said first and second panels at the overlapping areas thereof;

a valve being defined between said two valve side lines and the unsealed portions therebetween of said overlapping first and second panels;

said valve having an interior end defined by a portion of said first panel and having an exterior end defined by a portion of said second panel, the overlapping of said first and second panels defining a self-closing valve after opening thereof and filling the bag with the desired contents, said exterior end of said valve being sealed closed and slittable for opening for filling of the bag;

interconnecting means at least near said first edge connecting each bag to an adjacent bag to form an interconnected series of bags;

means on said interconnected series of bags for alignment of said series of bags for guidance of the series of bags along a reference line of a bag filling machine; and said alignment means being substantially parallel to said first edge.

2. A series of valve bags as set forth in claim 1, wherein said alignment means is a physical alignment surface for contact with a bag filling machine.

3. A series of valve bags as set forth in claim 1, wherein said alignment means is a portion of said walls substantially parallel to said first edge for sliding contact with a guide in a bag filling machine.

4. A series of valve bags as set forth in claim 1, wherein said alignment means is formed by said first edge.

5. A series of valve bags as set forth in claim 1, wherein said alignment means includes a tunnel on each bag substantially parallel to and near said first edge.

6. A series of valve bags as set forth in claim 5, wherein said tunnel is substantially continuous from one bag to the adjacent bag for serial threading of said bag tunnels by a mandrel guide in a bag filling machine.

7. A series of valve bags as set forth in claim 5, wherein said tunnel is formed adjacent said first edge of the bag and defined by tunnel portions of at least one of said walls and a tunnel seal spaced from said first edge.

8. A series of valve bags as set forth in claim 7, wherein said tunnel seal is discontinuous across the bag in a dimension parallel to said first edge, the discontinuity being at said valve for filling of the bag through said tunnel.

9. A series of valve bags as set forth in claim 1, wherein the closed valve is closed by a unitary part of said bag.

10. A series of valve bags as set forth in claim 1, wherein said interconnecting means is a unitary part of said first and second walls connected to the next adjacent bag in the series of interconnected bags.

11. An interconnected series of valve bags comprising, in combination, a first wall and a second wall connected together near all edges to form a substantially closed bag:

said first wall being formed from first and second panels partially overlapping each other;

a tunnel formed adjacent a first edge of the bag by first and second portions of at least one of said walls;

said tunnel being defined between said first edge and a tunnel seal spaced from said first edge with the tunnel seal being between said first and second tunnel portions;

a plurality of panel seals spaced from said first edge and sealing between said first and second panels at the overlapping areas of said panels with said plurality of seals terminating along a first valve side line perpendicular to said first edge;

a second valve side line including a seal perpendicular to said first edge and sealing between said first and second panels at the overlapping areas of said panels;

a valve being defined between said two valve side lines and between unsealed overlapping portions of said first and second panels;

the interior end of said valve being defined by an end of said first panel and the exterior end opening of said valve being sealed closed by said first edge of the bag at said tunnel, the overlapping of said first and second panels defining a self-closing valve after filling the bag with the desired contents, said tunnel being slittable near said bag first edge for filling of the bag through a portion of the tunnel and through the valve;

said tunnel portions being connected to adjacent bags in an interconnected series of bags to guide, orient, and align the bags movable serially onto a mandrel in a bag filling machine to have the tunnel slittable near the first edge thereof for release from the mandrel.

12. A valve bag as set forth in claim 11, wherein said tunnel seal is discontinuous across the bag in a dimension parallel to said first edge, the discontinuity being at said valve for filling of the bag through said tunnel.

13. A valve bag as set forth in claim 12, wherein said connection between said first and second walls includes gussets.

14. A valve bag as set forth in claim 12, wherein said bag is generally rectangular, with a long edge being said first edge.

15. A valve bag as set forth in claim 12, wherein said bag is generally rectangular, with a short edge being said first edge.

16. A valve bag as set forth in claim 15, wherein said connection between said first and second walls includes gussets.

17. A valve bag as set forth in claim 15, wherein said connection between said first and second walls is a direct connection for a pillow bag.

18. A valve bag as set forth in claim 11, wherein said closed valve exterior end is a part of said tunnel which is slittable near said first edge for the dual function of removing the bag from a mandrel threading the tunnel in a bag filling machine and to provide an opening for the filling of said bag through said valve.

19. A valve bag as set forth in claim 11, wherein said bag walls are made from a sealable flexible film.

20. A valve bag as set forth in claim 11, wherein said tunnel seal and said panel seals are substantially parallel to said first edge.

* * * * *